United States Patent [19]

Spinelli

[11] Patent Number: 4,573,247

[45] Date of Patent: Mar. 4, 1986

[54] ARTIFICIAL TREE LIMB MAKER MACHINE

[75] Inventor: Enrico Spinelli, Larciano, Italy

[73] Assignee: Mr. Christmas Incorporated, New York, N.Y.

[21] Appl. No.: 590,382

[22] Filed: Mar. 16, 1984

[51] Int. Cl.[4] ..... B23D 17/00; D02G 3/42; B21F 7/00

[52] U.S. Cl. ..... 29/417; 140/149; 57/24

[58] Field of Search ..... 57/203, 24; 29/417; 140/117, 118, 149

[56] References Cited

U.S. PATENT DOCUMENTS

| | | | |
|---|---|---|---|
| 1,514,787 | 11/1924 | Protz | 57/203 |
| 2,994,252 | 8/1961 | Lalick | 93/1 |
| 3,215,047 | 11/1965 | Braun | 93/1.5 |
| 3,323,973 | 6/1967 | Berzins | 161/22 |
| 3,343,357 | 9/1967 | Goodridge | 57/24 |
| 3,380,487 | 4/1968 | Kraszeski et al. | 140/149 |
| 3,513,063 | 5/1970 | Sloane | 161/22 |
| 3,594,260 | 7/1971 | Dieffenbach | 140/149 |
| 3,596,998 | 8/1971 | Romanowski et al. | 140/149 |
| 3,657,870 | 4/1972 | Marks | 57/24 |
| 3,665,577 | 5/1972 | Dieffenbach | 29/33 F |
| 3,791,421 | 2/1974 | Barrett | 140/149 |
| 3,834,976 | 9/1974 | Mottel | 161/22 |

*Primary Examiner*—Howard N. Goldberg
*Assistant Examiner*—Steven Nichols
*Attorney, Agent, or Firm*—Sheridan Neimark; Karl W. Flocks; A. Fred Starobin

[57] ABSTRACT

A machine for making artificial limbs as for a Christmas tree where twisted wires having simulated needles attached are fed by a reciprocating transverse action to a pair of cutters which cut the wires to predetermined lengths while at the same time a pair of wires and a strand of decorative material are fed between a pair of pulleys where the cut lengths are attached perpendicularly to the pair of wires and decorative strand being twisted.

11 Claims, 10 Drawing Figures

ARTIFICIAL TREE LIMB MAKER MACHINE

BACKGROUND OF THE INVENTION

The present invention relates to the manufacture of artificial branch assemblies and more particularly to a machine for making artificial pine limbs used for the manufacture of artificial Christmas trees.

In prior art methods and machines for manufacturing artificial limbs the limbs must usually involve additional steps and handling to cut them and, in some cases, shape them with separate steps of assembling and attaching needles and attaching together to form the artificial branch. Each step used adds to the time and expense of manufacture.

SUMMARY OF THE INVENTION

It is an object of the present invention to assemble artificial limbs such as may be used to manufacture artificial pine trees in a speedy and inexpensive manner.

It is a further object of the present invention to do this assembly in a single machine which performs the work in a continuous manner.

Basically the present invention is a machine which makes a simulated pine tree limb from a continuous wire, having the needles already attached thereon, which wire is cut and formed into a branch in this machine.

In the present invention the machine disclosed uses a continuous wire having simulated pine needles attached thereto, cutting this wire to form twigs and immediately twists each of the twigs into a pair of continually twisting wires, both the pair of twisting wires and the twigs being fed as a continuous wire or wires to the machine with continuous non-stop operation of the machine.

BRIEF DESCRIPTION OF THE DRAWINGS

The above and other objects and advantages will be apparent from the description of the present invention and the accompanying drawings in which.

DESCRIPTION OF THE PREFERRED EMBODIMENT

Figure 1:
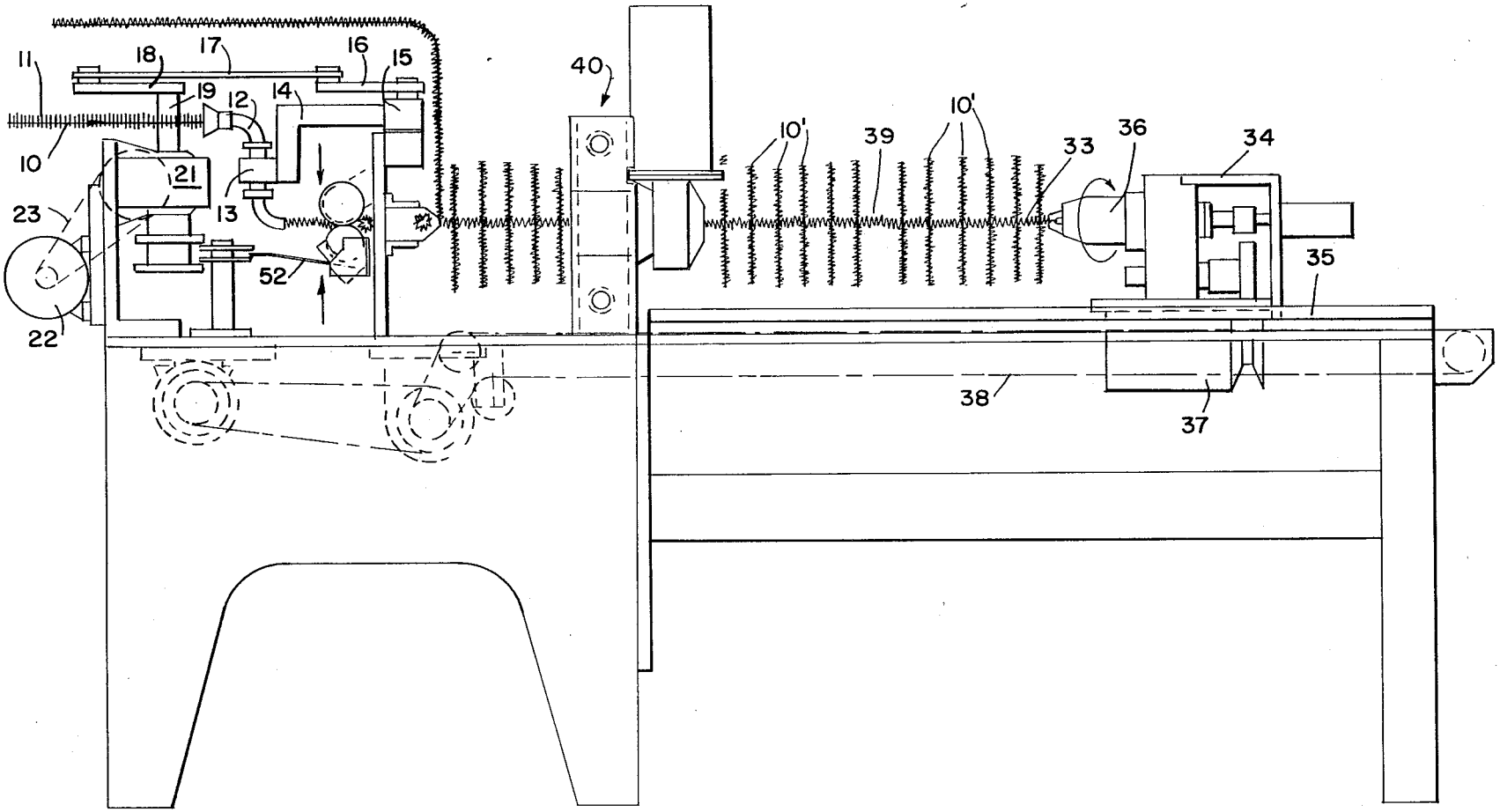
FIG. 1 is a side elevational view of the overall machine of the present invention.
Figure 2:
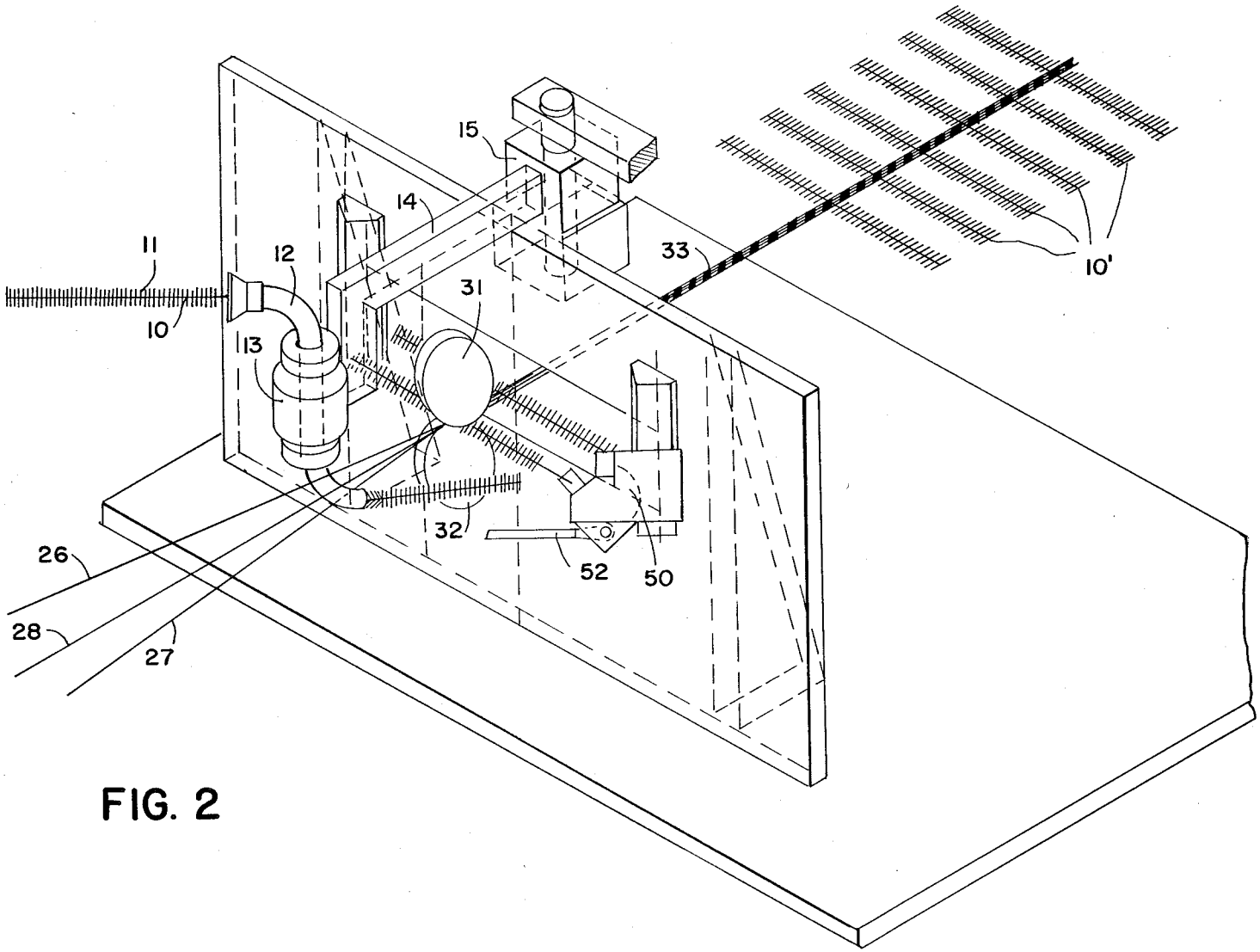
FIG. 2 is a perspective view of the folding-cutting twig forming end of the machine viewing from the left side of the machine of the present invention.

Referring first to FIGS. 1 and 2, there is shown a pair of twisted wires 10 with simulated pine or fir needles 11, for example, a monofilament cut in short lengths, which are fed through tube 12 which is swivel-mounted in holder 13 which is mounted on support arm 14 connected to carrier or distributor 15 which is mounted for transverse movement relative to the limb maker machine.

Carrier 15 is moved transversely through the pivotal movements of arms 16, 17 and 18 and rotating shaft 19, rotated from gear box 21 through motor 22 and belt 23 arrangement.

At the same time that twisted wires 10 with needles 11 are moving through tube 12 into the machine, wires 26 and 27, with a strand 28 of decorative material to add to the look of the wires to give a better appearance as a branch of a tree, are fed into the peripheral grooves of pulleys 31 and 32. The twisted wires 10 with needles 11 are fed as shown in FIG. 2, positioned perendicular to and in between wires 26 and 27 so as to be disposed between wires 26 and 27 when they emerge from between pulleys 31 and 32 as twisted strands 33 with cut lengths 10' therebetween.

Carriage 34 riding in track 35 carries rotating chuck 36 which is rotated through gearing and belts connected to motor 37. Carriage 34 and attached motor 37 are moved along track 35 by motor driven belt 38. Rotating chuck 36 grasps strands 33, twisting and maintaining tension on strands 33 throughout the process of manufacturing the artificial tree limbs.

The speed of movement of carriage 34 is variable and is varied to determine the spacing of cut lengths 10' along strands 33. This speed is also set so as to vary between groups of cut lengths 10' and introduce an enlarged spacing 39 between such groups, as illustrated between a group of six cut lengths 10'. Each branch will consist of two such groups and will be cut by limb cutter 40 further illustrated in more detail in the enlarged illustration of FIG. 3.

Figure 3:
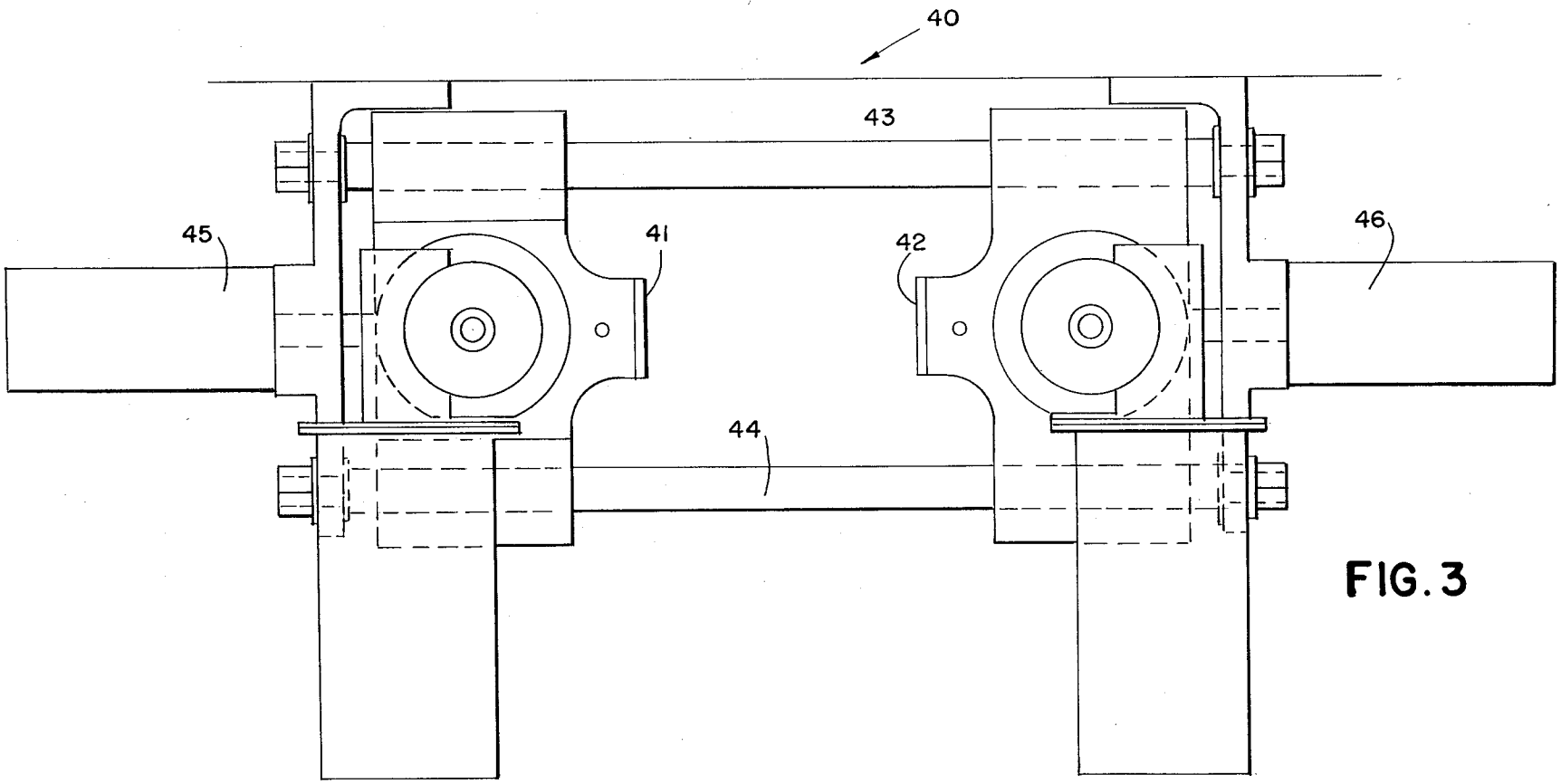
FIG. 3 is an end view of the limb cutter portion of the machine.

As shown in FIG. 3, cutters 41 and 42 are mounted for reciprocating movement on rails 43,44. Cutters 41, 42 are moved respectively by air cylinders 45 and 46.

Figure 4:
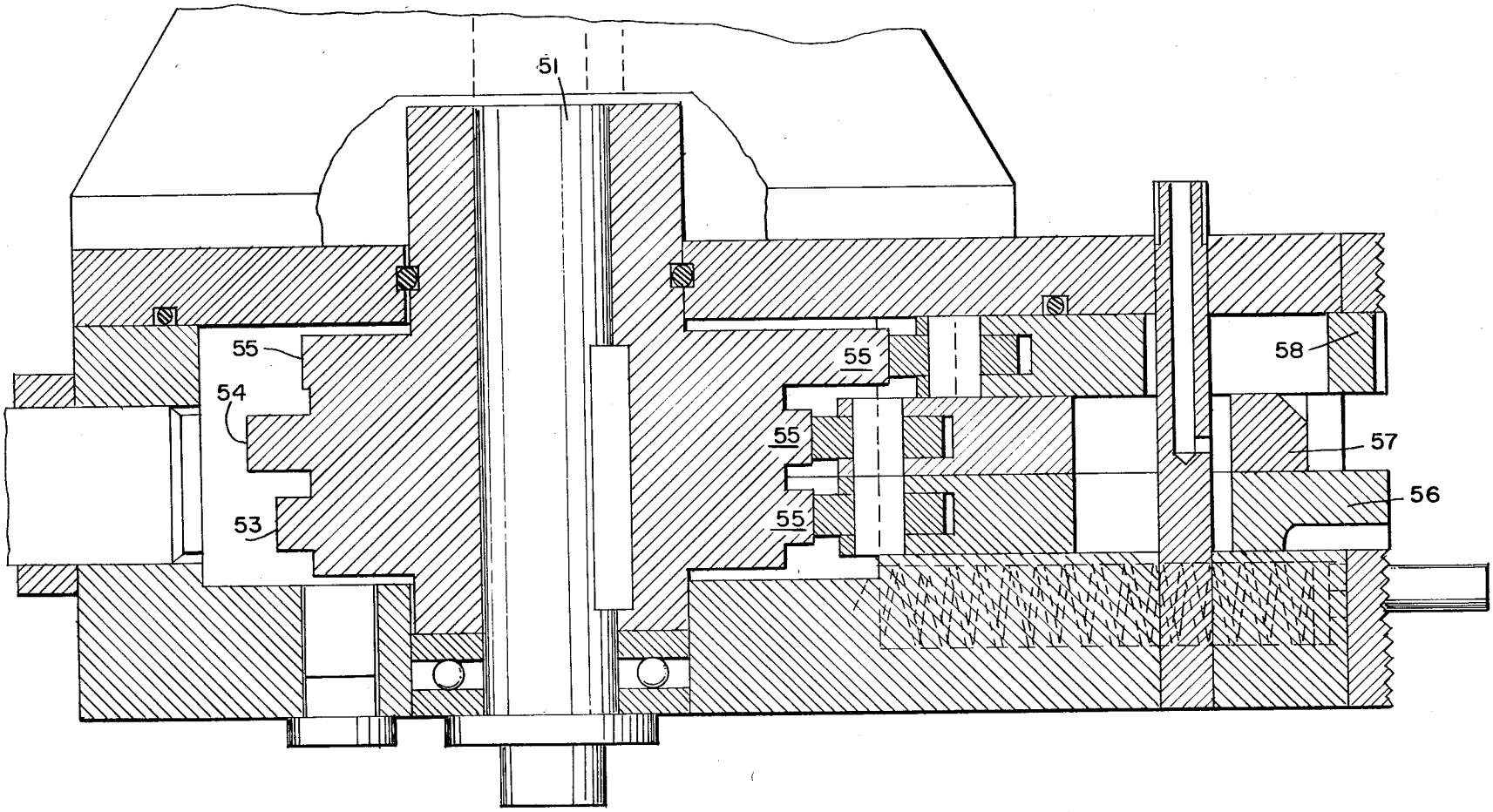
FIG. 4 is a top view in section of the limb bending and forming portion of the machine with the cams controlling the operation.
Figure 5:
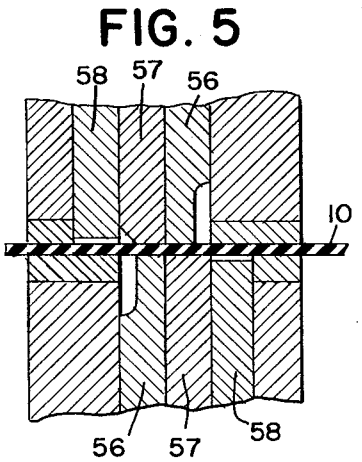
FIGS. 5 through 9 illustrate the machine cutting and bending operation.

In order to form cut lengths 10' and attach them to strands 33 the mechanism illustrated in FIGS. 2 and 4 is used with the steps in its use illustrated in FIGS. 5–9.

Wires 10 with simulated needles 11 held therein are fed continuously through tube 12 to cutters 50 alternately on opposite sides of pulleys 31, 32 by transverse movement of tube 12 in holder 13. At each of cutters 50 (only one shown on FIG. 2) wires 10 are cut at the end of each cross movement of tube 12 with the end of wires 10 (or cut length 10') held until the next transverse movement.

This cutting of wires 10 along with bending of the ends of cut lengths 10' is accomplished by the mechanism shown in FIG. 4. A shaft 51 with power through rod 52 rotates three cams 53, 54 and 55 which operate cutting slide element 56 and bending side elements 57 and 58 respectively.

Figure 6:
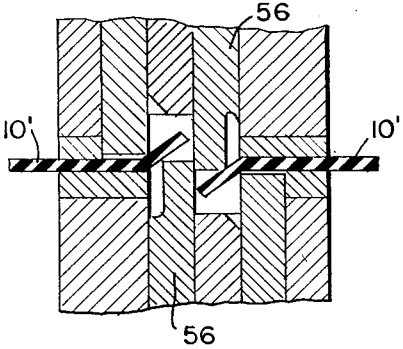
Figure 7:
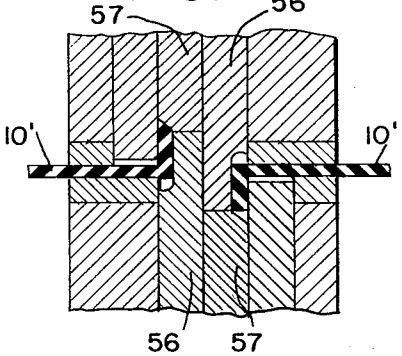

Their operation as illustrated in FIGS. 5–9 are as follows. The slide elements 56, 57 and 58 start in the positions shown in FIG. 5. A clear path is shown between the elements as they move together with twisted wires 10 between them. Cam 53 moves cutting slide elements 56 inward past each other to perform the initial cutting of wires 10 into cut lengths 10' and the start of the bending of cut lengths 10' as shown in FIG. 6. When cutting slide elements 56 are fully extended through the horizontal axis of lengths 10' as shown in FIG. 7, the ends of lengths 10' are bent at an angle of 90° to those lengths. This is performed by the elongated notches 59 which bring the wire ends to their 90° position. Note that bending slide elements 57 in opposite positions to slide elements 56 have withdrawn from the horizontal axis of lengths 10' to allow room for the bending operation of FIGS. 5 and 7. By the motion of cams 53 and 54, slide elements 56 now withdraw and slide elements 57 go forward toward the horizontal axis.

Figure 8:
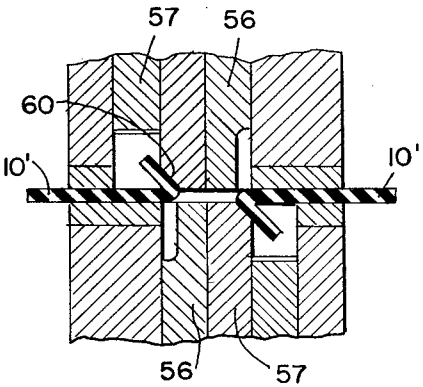
Figure 9:
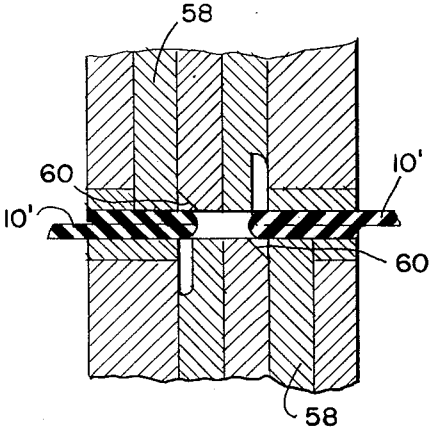
Figure 10:
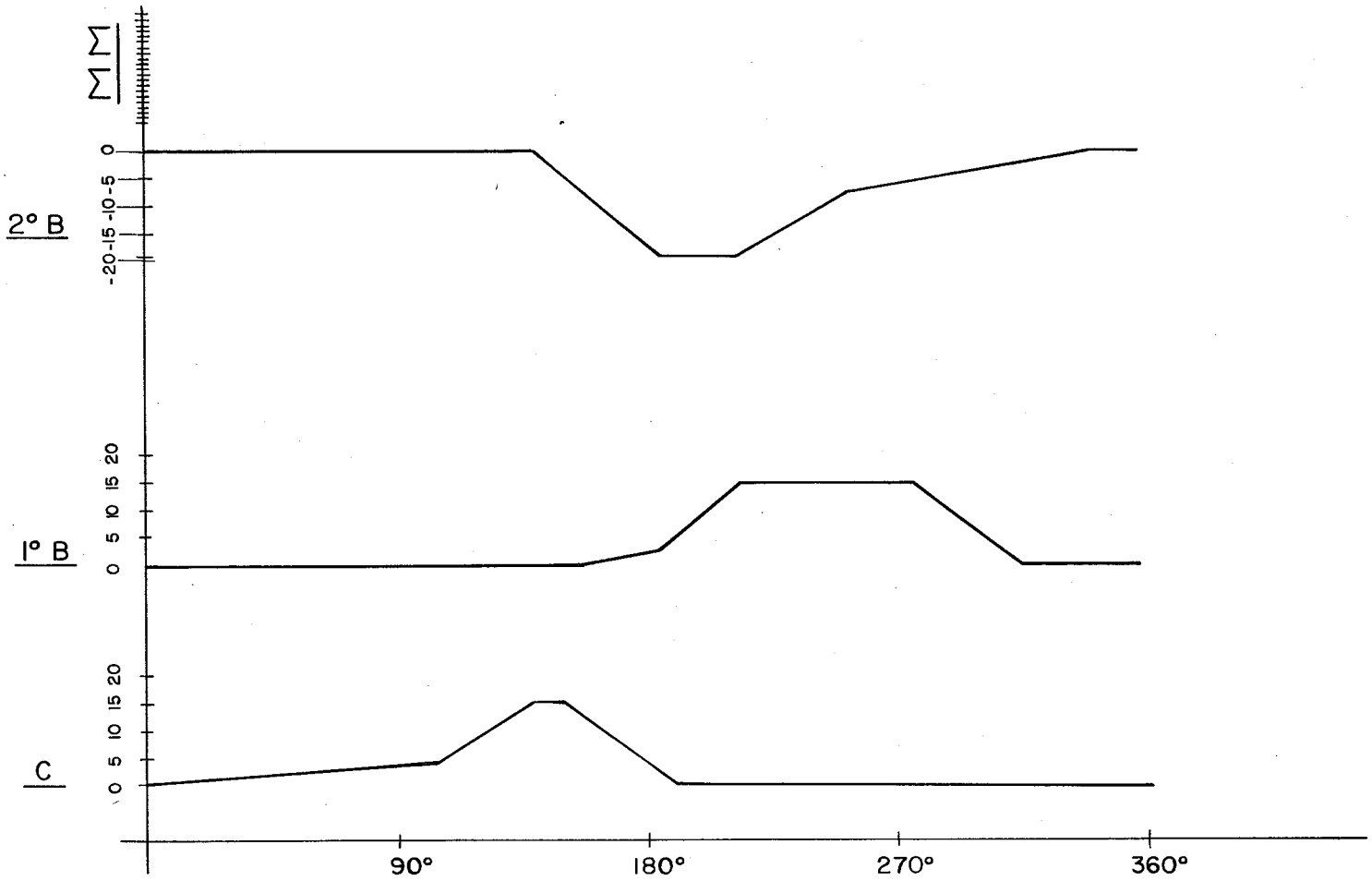
FIG. 10 illustrates graphically the cam movement of the cam in FIG. 4.

As shown in FIG. 8, the bent ends of lengths 10' are further bent to approximately 45° by notches 60 in slide elements 57. In the last step as illustrated in FIG. 9, cam 55 moves bending slide elements 58 toward the horizontal axis of lengths 10' to complete the bend to a 180° bend. At this point, the slide elements 56, 57 and 58 are back to their original position of FIG. 5, ready to separate and then receive the next portion of wires 10. The surfaces of the cams 53, 54 and 55 relative to each other during a complete 360° rotation is illustrated graphically in FIG. 10. The column on the left side has legends wherein C refers to the cam operating cutting slide elements 56, 1° B. refers to first bending slide elements 57, and 2° B. refers to second bending slide elements 58.

Therefore, not only is a branch for an artificial tree formed by a continuous and back and forth action combined for continuous operation, but included in the action is the bending of the ends to prevent sharp ends which would add to the possibility of accident.

It will be obvious to those skilled in the art that various changes may be made without departing from the scope of the invention and the invention is not to be considered limited to what is shown in the drawings and described in the specification.

What is claimed is:

1. A machine for making artificial limbs comprising first means for feeding twisted wires with simulated needles therein, second means for feeding wires and decorative material, said first means feeding the twisted wires with simulated needles between the wires fed from said second means, a pulley means receiving said wires and decorative material from said second means, a pair of spaced cutters receiving said wires with simulated needles from said first means, means to hold and twist said wires and decorative material, with cut lengths of said wires with simulated needles disposed between twisted wires of said wires and decorative material, said pulley means positioning said wires with simulated needles substantially perpendicularly to said wires with decorative material for attachment to said twisted wires and decorative material.

2. The machine of claim 1, further characterized by said firs means mounted for transverse movement reciprocating past each of said spaced cutters in turn.

3. The machine of claim 1, further characterized by each of said cutters including sliding elements, and cam means controlling movement of said sliding elements.

4. The machine of claim 3, further characterized by said sliding elements including a set of at least three elements positioned to move toward and away from a set of three similar elements.

5. The machine of claim 4, further characterized by a first one of each of said sets of elements having a notch means to bend an end of said wire with simulated needles at an angle of 90° to said last mentioned wire, a second one of each of said sets of elements having a notch means to complete the bend of said last mentioned wires to substantially a 180° bend.

6. The machine of claim 1, further characterized by air cylinder operated cutting means positioned along said twisted wires and decorative material after said pulley means to cut said twisted wires and decorative material upon completion of an artificial limb.

7. The machine of claim 1, further characterized by said holding and twisting means mounted for movement longitudinally of the machine in the direction of movement of said twisted wires and decorative material.

8. A method of making an artificial tree limb comprising the steps of feeding twisted wires with simulated needles therein to a pair of spaced cutters by a reciprocating motion transverse to the machine, feeding wires and decorative material to a pair of pulleys, cutting the twisted wires with simulated needles to lengths determined by the distance between said spaced cutters, twisting said wires and decorative material and catching said lengths of wires with simulated needles therein in a position substantially perpendicular to said wires with decorative material.

9. The method of claim 8, further characterized by bending the ends of the cut lengths of said twisted wires with simulated needles following the step of cutting.

10. The method of claim 9, further characterized by the steps of cutting and bending performed by the cammed operation of cutting and bending slide elements.

11. The method of claim 8, further characterized by cutting said twisted wires and decorative material after a predetermined number of lengths of wires with simulated needles have been wound therein to form an artificial limb.

* * * * *